United States Patent [19]

McEnery et al.

[11] 4,299,298

[45] Nov. 10, 1981

[54] DOWN-THE-HOLE DRILLING

[75] Inventors: James O. McEnery, Ennis; Frank W. Morton, Shannon; John J. O'Dea, Clareview, all of Ireland

[73] Assignee: Boart International Limited, Johannesburg, South Africa

[21] Appl. No.: 168,399

[22] Filed: Jul. 10, 1980

Related U.S. Application Data

[63] Continuation of Ser. No. 3,038, Jan. 12, 1979, abandoned.

[51] Int. Cl.[3] ..... E21B 10/60

[52] U.S. Cl. ..... 175/418; 175/400; 175/92; 175/393

[58] Field of Search ..... 175/92, 100, 135, 393, 175/400, 410, 417, 418, 107, 215; 173/15, 80, 138

[56] References Cited

U.S. PATENT DOCUMENTS

| | | | |
|---|---|---|---|
| 604,538 | 5/1898 | Leyner | 175/135 |
| 1,943,880 | 1/1934 | Rea | 175/393X |
| 2,085,941 | 7/1937 | Arnold | 175/417 |
| 2,149,798 | 3/1939 | Starkey | 175/393 X |
| 2,390,646 | 12/1945 | Hays | 175/107 X |
| 2,913,225 | 11/1959 | Wolfram | 175/135 |
| 2,990,894 | 7/1961 | Mitchell et al. | 175/100 X |
| 3,225,841 | 12/1965 | Thompson | 173/15 |
| 3,527,239 | 9/1970 | Boom | 175/92 X |
| 3,986,565 | 10/1976 | Atkinson | 173/80 X |
| 4,079,793 | 3/1978 | Mosely et al. | 173/80 |

FOREIGN PATENT DOCUMENTS

| | | | |
|---|---|---|---|
| 868781 | 4/1971 | Canada | 175/418 |
| 870463 | 5/1971 | Canada | 175/417 |
| 1255065 | 11/1967 | Fed. Rep. of Germany | 175/418 |
| 1018590 | 2/1966 | United Kingdom | 175/215 |
| 1071418 | 6/1967 | United Kingdom | 175/418 |
| 307183 | 7/1971 | U.S.S.R. | 175/417 |

*Primary Examiner*—James A. Leppink
*Assistant Examiner*—Richard E. Favreau
*Attorney, Agent, or Firm*—Cushman, Darby & Cushman

[57] ABSTRACT

The invention concerns down-the-hole drilling, where there is a persistent problem in providing an adequately controlled flow of flushing fluid to the face of the drill bit. In known down-the-hole drills turbulence and closed circuits of the flushing fluid tend to erode the bit and reduce its lifespan. The invention seeks to lessen these drawbacks by providing for the flow of flushing fluid to be divided into a component directed along a first cavity which terminates at the face of the bit and another component directed along a second cavity which terminates above the face and is deflected up the drill hole. Weakening of the bit is avoided if there is at most one bore through the bit for flushing fluid.

6 Claims, 5 Drawing Figures

DOWN-THE-HOLE DRILLING

This is a continuation of application Ser. No. 3,038 filed Jan. 12, 1979 (now abandoned).

BACKGROUND OF THE INVENTION

This invention relates to down-the-hole drilling and provides improvements in the provision of flushing fluid in the vicinity of the bit head of a down-the-hole drill in order to facilitate the removal of rock chips from the hole. The fluid will normally be air but could be an air-liquid mixture or, in a purely hydraulic drill, liquid only.

In a down-the-hole drill, the hammer mechanism acts directly on a drill bit at the bottom of the hole and the forces on the bit are direct and large. It is therefore necessary to use a bit of considerable strength. Flushing fluid is supplied to the bit, often through a generally axial hole which extends through the shank of the bit to the face which acts on the floor of the hole, and sometimes through a series of grooves extending generally longitudinally along the shank of the bit and terminating at the face.

It is also known (from West German Pat. No. 1 238 864) to provide a pair of flushing holes in the bit, the holes leading from passages in the drill body to the top of the head and passing through the head. The holes are located opposite each other. It is however undesirable for the bit of a down-the-hole drill to be weakened by numerous internal cavities, so that a bit formed with two or more generally longitudinal holes through it is not as strong as may be wished. Two holes are however generally considered desirable where the bit is of the blade type, being provided because of the symmetry of the cruciform blade arrangement at the face of the bit. Apart from being structurally relatively weak, this arrangement also leads to undesirable turbulence and to closed air circuits at the bit head, which in turn lead to premature wear of the bit.

In another arrangement (known from U.S. Pat. No. 3,225,841) a central bore in the bit is provided, terminating in an orifice at the centre of the face. There is also a series of downwardly sloping passages extending from the central bore to the sides of the bit, where the passages end in grooves which direct the flushing air downwards to sweep the face of the bit. This arrangement suffers from the structural weakness inherent in bits with several internal cavities, and there is again considerable turbulence at the face, where the streams of flushing fluid tend to converge, and hence premature wear.

In out-of-the-hole drilling technology it is common to provide a longitudinal channel for flushing fluid along the drill stem or string which extends from the drill body to the bit. In such drills the head of the bit is usually considerably larger in diameter, compared to the diameter of the stem behind it, than is the case in down-the-hole drills, where the reduction in cross-sectional area of the apparatus directly behind the head of the bit is relatively slight since the casing housing the hammer mechanism is located immediately above the bit.

In out-of-the-hole drilling, the reduction in cross-section mentioned above has the consequence that the flushing fluid tends to expand into the space in the hole immediately behind the head, slowing down the overall flow. This has an unfavourable effect on the flushing action since the velocity of the flushing fluid should be maintained if the fluid is to perform a proper sweeping action.

To overcome this problem of out-of-the-hole drilling, it is known (for example from U.K. Pat. No. 1,071,418) to provide a central longitudinal bore through the drill bit, extending to the centre of the face, and also a series of further bores which extend from the central longitudinal cavity through the side wall of the bit, some being sloped towards the face and others away from the face. This arrangement divides the stream of flushing fluid and creates a venturi effect in which there is a high-pressure region at the face itself. Chips from the face are drawn from this area into a low-pressure region further up the hole where they are entrained in the rapidly moving stream of flushing fluid and conveyed up the hole.

In such drills the bit is naturally weakened by the presence of multiple bores and such bits would be inapplicable in down-the-hole drilling. Moreover the characteristics of the fluid available for flushing are entirely different compared with down-the-hole drills. The less marked difference in relative areas between the head and the zone behind the head also reduces the theoretical desirability of the venturi effect.

SUMMARY OF THE INVENTION

An object of the invention is to provide the down-the-hole drilling means for improving the control of the flushing action of the flushing fluid and thereby making drilling more efficient than in known equipment and reducing wear of the bit.

The invention provides a bit for a down-the-hole drill, the bit having a shank and a head and being formed with at least two cavities for conveying flushing fluid from the interior of the drill to the exterior, the first of the cavities extending to the face of the head and the second cavity terminating above the face and being adapted to deflect upwards the flushing fluid which it conveys.

The second cavity is conveniently a groove in the material of the bit, terminating in a zone above the level of the head and extending generally transversely with respect to the axis of the bit. The first and second cavities also preferably extend independently of each other in the bit, and preferably not more than one of them is a bore. There may be a plurality of the first and second cavities. The invention is particularly but not exclusively suitable for button bits, where the existence of the buttons allows a freer flow of fluid at the bit face than occurs in blade-type bits.

The flow of flushing fluid to the face of the bit is preferably lesser than the flow of fluid deflected up the hole.

DESCRIPTION OF PREFERRED EMBODIMENTS

Figure 1:
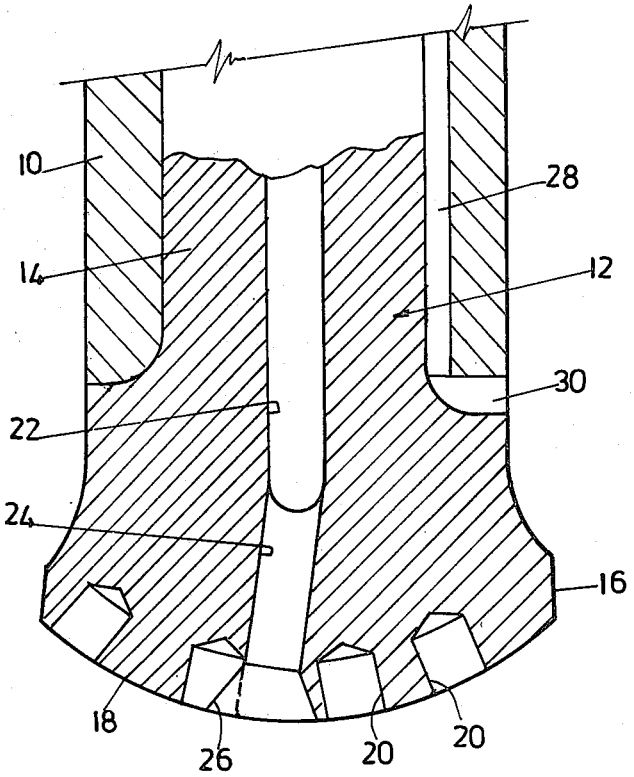
FIG. 1 is a simplified fragmentary longitudinal section through the lower end of a down-the-hole drill fitted with a bit of the invention.

In FIG. 1, a pneumatic down-the-hole drill includes a casing 10 having a lower end into which is fitted a bit 12 of the invention, seen only fragmentarily. The bit 12 has a shank 14 and a head 16. The upper part of the shank is conventional as regards the manner in which it is supported in the casing 10. The face 18 of the bit is adapted to carry a series of buttons fixed in blind holes 20, the buttons being removed for the sake of simplicity. The arrangements for imparting percussive force to the bit and for rotating the drill assembly in the hole are conventional.

The shank 14 has an internal bore 22 which extends axially from the upper tip of the bit and merges near the head 16 with an oblique bore 24 having a mouth 26 in the face 18.

The casing 10 of the drill includes an internal longitudinal groove 28 which extends along the full length of the shank 14 and which carries flushing air. It terminates at the end of the casing 10, where the flushing air is directed into a groove or channel 30 formed in the material of the bit 12 in the surface abutting the lower edge of the casing 10 and so shaped as to deflect the air arriving from the groove 28 outwards into the hole and upwards in it, thus back up the hole. The groove 30 shown, which leaves the drill at right angles to its vertical axis, is suitable for this purpose. The passages 22, 24, 28 and 30 are so sized in relation to the air supply in the drill that somewhat less than half the air flow, and preferably about 25%, arrives at the face of the bit through the bores 22, 24, the remainder being directed through the passage 28 and deflected by the groove 30 up the hole. The result is that a low pressure area is created in the hole at the level of the groove 30, and air and rock chips from below are drawn upwards into this zone and from it blown out of the hole. The effect is to reduce turbulence and to allow a steadier and more controlled flow of air across the force of the bit. The removal of chips is thus more effective in the face area.

Figure 5:
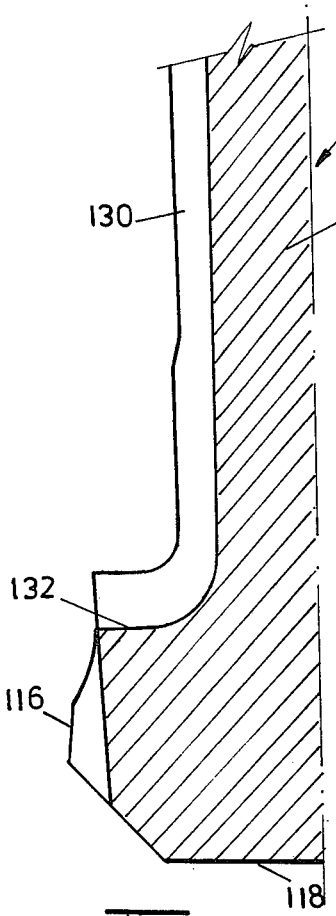
FIG. 5 is a semi-section of the bit of FIGS. 4 and 5 showing a longitudinal flushing groove in it.
Figure 3:
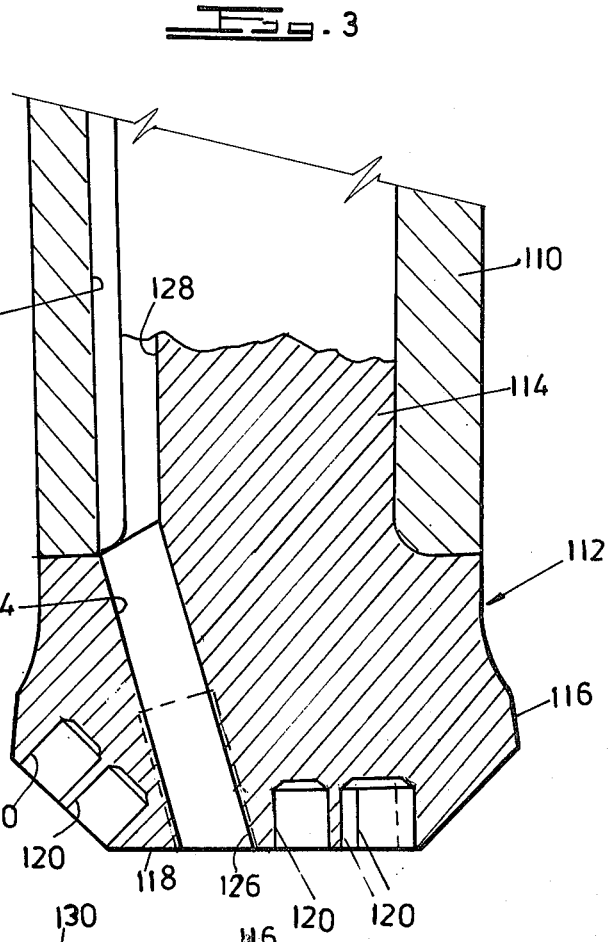
FIG. 3 is a view similar to FIG. 1 of a further embodiment of the invention.
Figure 4:
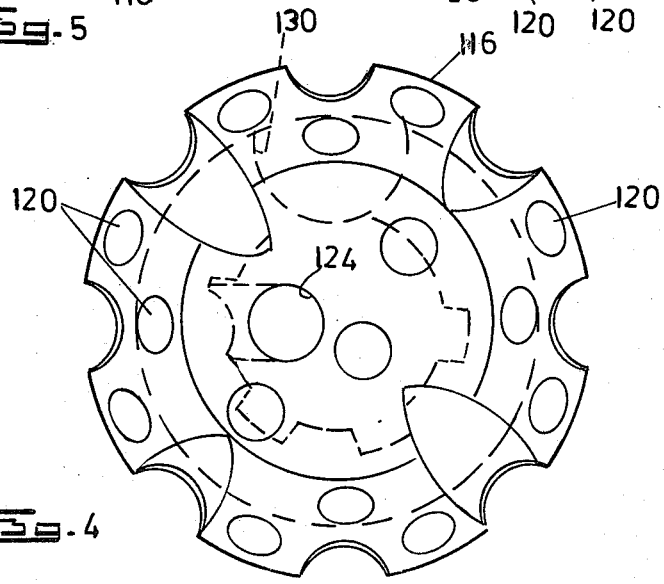
FIG. 4 is a view of the bit of FIG. 3, similar to the view of FIG. 2.

In the version of FIGS. 3–5, a drill casing 110 is fitted with a bit 112 that includes a shank 114 and a head 116. The head 116 has a face 118 with buttons (not shown) fixed in holes 120.

The drill casing 110 has on one side an internal groove 122 which at its lower end joins a bore 124 formed obliquely in the material of the head of the bit and ends in a mouth 126 in the face 118. There is no axial bore in the shank of the bit, but a longitudinal groove 128 on its side surface registers with the groove 122 in the wall of the casing 110 of the drill to form a passage of approximately the same cross-sectional area as the bore 124. Thus flushing air in the interior of the drill is conveyed through the passage defined by the grooves 122, 128 into the bore 124 and finally emerges in the drill hole through the mouth 126, where it has a flushing action.

As is best seen in FIGS. 4 and 5, the shank 114 of the bit 112 is provided, at 90° angular displacement round the axis of the shank from the bore 124, with a further groove 130 which extends the full length of the shank and joins a deflection groove 132 formed in the head of the bit. The groove 130 registers with a suitably shaped groove (not illustrated) in the inner surface of the casing 110 so that a further passage down the shank is created for air which passes out of the drill assembly through the deflection groove 132 and passes up the hole, creating a low pressure area below it to attract upwards air and rock chips.

Figure 2:
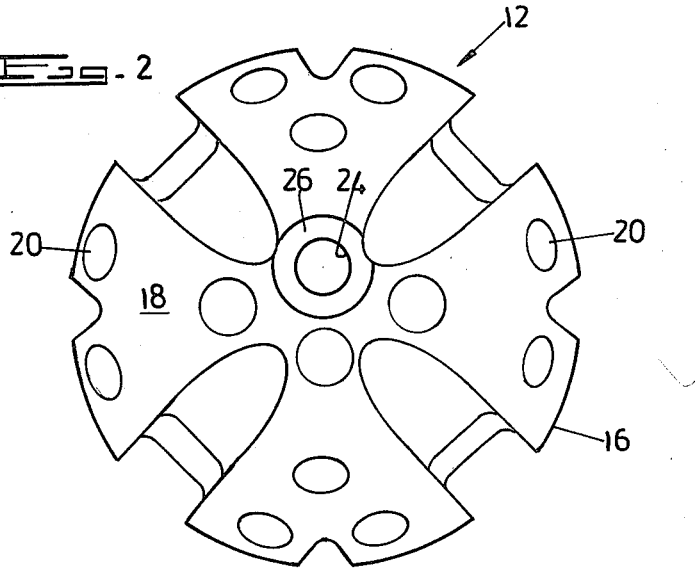
FIG. 2 is an underplan view of the bit of FIG. 1.

The combined action of the air stream directed into the floor of the hole and that deflected upwards from the floor of the groove 132 is much as was described in relation to the embodiment of FIGS. 1 and 2.

Note that in both the embodiments mentioned above the flushing cavity extending to the face of the bit is completely independent of the cavity supplying flushing air to the exterior of the bit above the face. This arrangement naturally calls for the air supply in the mechanism of the drill body above the bit to be divided into two streams.

OTHER EMBODIMENTS

Among further variants (not illustrated) of the invention is one in which the air supply to the face of the bit is delivered not through a bore but through a groove in the external surface of the bit, the groove following the general outline of the bit and terminating in an off-centre zone in the face. The second cavity may in this case be a bore in the bit but is preferably a further groove in the shank, conveniently one which registers with another groove formed in the casing, and terminating in a transverse extension such as the grooves 30 or 132 illustrated.

In another variant there is not one but a plurality of cavities supplying flushing fluid from the interior of the drill to points on the periphery of the bit above the face for deflection up the hole to create a low-pressure zone drawing chips from below.

ADVANTAGES

In preliminary trials of drills of the invention under practical operating conditions it has been found that erosion and wear of the bit have been substantially reduced, in some cases increasing the life of the bit by more than 20% compared to comparable known bits.

It would seem that the chief advantage of the invention is that it improves the control which can be exerted of the flushing action at the face by reducing or eliminating turbulence and closed air circuits, the venturi effect explained above being a secondary advantage.

We claim:

1. A down-the-hole drill, comprising: a casing having a lower end and a bit; said bit comprising:

a shank surrounded by said casing;

a head having a working face, said head being formed integrally with said shank, said head protruding downwardly beyond the lower end of said casing; and surface means defining a shoulder between said shank and said head;

means defining at least two independent cavities in said bit, arranged to convey flushing fluid from within said drill to the exterior of said drill, and including:

a first cavity extending to said working face, and a second cavity in the form of a groove formed in said shoulder, said groove extending across said shoulder from the outside to the inside of said shoulder and having a floor arranged for upwardly-deflecting flushing fluid conveyed through the groove as such fluid leaves the groove.

2. A bit for a down-the-hole drill, said bit comprising:

a shank adapted in use to be surrounded by a casing of the drill;

a head having a working face, said head being formed integrally with said shank, and being adapted in use to protrude beyond said drill casing; and surface means defining a shoulder between said shank and said head;

means defining at least two independent cavities in said bit, arranged to convey flushing fluid from within said drill to the exterior of said drill, and including:

a first cavity extending to said working face; and a second cavity in the form of a groove formed in said shoulder, said groove extending across said shoulder from the outside to the inside of said shoulder and having a floor arranged for upwardly-deflecting flushing fluid conveyed through the groove as such fluid leaves the groove.

3. The bit of claim 2 in which one of the cavities is a bore extending through at least a part of the bit, this being the only bore for flushing fluid in the bit.

4. The bit of claim 2 in which the first cavity is adapted to convey approximately 25% of the flushing fluid to the face.

5. The bit of claim 3 in which the bore extends along the full length of the bit.

6. The bit of claim 3 in which the bore extends through the head only.

* * * * *